US011311092B1

(12) United States Patent
Yan

(10) Patent No.: US 11,311,092 B1
(45) Date of Patent: Apr. 26, 2022

(54) GLUE-FREE CASE FOR A STICK PRODUCT

(71) Applicant: ELC Management LLC, Melville, NY (US)

(72) Inventor: Jian Yan, Kirkland (CA)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 17/148,702

(22) Filed: Jan. 14, 2021

(51) Int. Cl.

| | |
|---|---|
| ***B43K 21/08*** | (2006.01) |
| ***A45D 40/06*** | (2006.01) |
| ***A45D 40/02*** | (2006.01) |
| ***A45D 40/12*** | (2006.01) |
| *A45D 40/00* | (2006.01) |

(52) U.S. Cl.
CPC ..... *A45D 40/06* (2013.01); *A45D 40/02* (2013.01); *A45D 40/12* (2013.01); *A45D 2040/0062* (2013.01)

(58) Field of Classification Search
CPC ..... A45D 40/02; A45D 40/06; A45D 40/12
USPC ..... 401/75
See application file for complete search history.

(56) References Cited

U.S. PATENT DOCUMENTS 9,603,434 B2 3/2017 Zhu et al.
10,881,184 B1 * 1/2021 Yan ..... A45D 40/06

FOREIGN PATENT DOCUMENTS

WO WO-2021128657 A1 * 7/2021 ..... A45D 40/06

* cited by examiner

*Primary Examiner* — Jennifer C Chiang
(74) *Attorney, Agent, or Firm* — Peter Giancana

(57) ABSTRACT

A glue-free lipstick case that comprises an A-shell and cam sleeve with no glue in between. The cam sleeve is provided with one or more flexible tabs on its outer surface. The flexible tabs bias in a radially outward direction. The A-shell member fits snugly over the cam sleeve and flexible tabs, such that the outward pressure exerted by the tabs on the inner surface of the cam sleeve helps to ensure that the two members move as one.

7 Claims, 5 Drawing Sheets

GLUE-FREE CASE FOR A STICK PRODUCT

FIELD OF THE INVENTION

The present invention relates to a container for housing a stick product, such as lipstick.

BACKGROUND

A well known type of container (100) for an stick product features a base (3) that is connected to a cylindrical inner body (4), and a cam sleeve (1') placed around the inner body, such that the cam sleeve and body can rotate with respect to each other. The inner body is hollow, and has a wall with at least one longitudinal slot that extends through the wall. The cam sleeve has an inner wall that features at least one helical groove that extends along a substantial length of the inner wall. A product holder cup (5) is provided with at least one cam follower in the form of a lug. When the holder cup is fitted into the inner body, the lug extends through the longitudinal slot of the inner body to engage the helical groove of the cam sleeve. In this arrangement, when the inner body is rotated (by rotating the base) relative to the cam sleeve, then the helical groove of the cam sleeve applies pressure to the lug of the holder cup, which drives the holder cup up or down in the longitudinal slot of the inner body, thereby moving the stick product between an advanced and a retracted position. As is commonly done, a cylindrical A-shell member is positioned over the cam sleeve, and glue is used between the A-shell and cam sleeve to ensure that these two members move as one. Because the base is connected to the inner body, and the A-shell is connected to the cam sleeve by glue, raising and lowering of the holder cup is achieved by rotating the A-shell relative to the base.

In assembly, some amount of glue is applied to the inner surface of the A-shell. The use of glue between the A-shell and cam sleeve is problematic. For example, after glue is applied to the inner surface of the A-shell, and while the glue is still wet, the cam sleeve is slid into the A-shell. This may force some of the glue toward the end of the cam sleeve where it will escape from between the cam sleeve and A-shell. This makes assembly messy, and incurs unwanted costs for cleaning and extra time to assemble. Also, the glue may contact the stick product, thus contaminating it. In this case, the product has to be discarded. Also, the amount and positioning of the of glue may no longer be suitable to ensure that the cam sleeve and A-shell will move as one over the life of the container.

To avoid these problems, U.S. Pat. No. 9,603,434 describes a lipstick tube assembly that does not use glue. That lipstick tube includes two different structural features that fix the A-shell to the spiral (i.e. cam sleeve). The key-slot structure is used for the circumferential fixation of the spiral and the A-shell. The clasp-clamping-groove structure is used for the axial fixation of the spiral and the A-shell. During the assembly, the spiral and the A-shell must be fixedly matched with each other by the two structures. The greatest disadvantage of this, and other mechanisms, is the need for a relatively complicated A-shell design. The A-shell, which in its simplest form is a thin-walled tube, becomes rather more complex, requiring a multiplicity of axial splines formed on the inner surface, and an edged that is curled back on itself. The cam sleeve also requires extensive customization, such as 90 longitudinal grooves on its outer surface to engage the splines of the A-shell. While glue is not used, the design is complicated and relatively costly. In contrast, the present invention requires minor customization of the cam sleeve and no alteration of the conventional A-shell.

OBJECTS OF THE INVENTION

A main object of the present invention is to provide a mechanism for a stick product wherein the A-shell-to-cam sleeve assembly is simple and does not use glue.

SUMMARY

A glue-free lipstick case according to the present invention comprises an A-shell and cam sleeve with no glue in between. Rather, the cam sleeve is provided with one or more flexible tabs on its outer surface. The flexible tabs bias in a radially outward direction. The A-shell member fits snugly over the cam sleeve and flexible tabs, such that the outward pressure exerted by the tabs on the inner surface of the cam sleeve helps to ensure that the two members move as one. Optionally, an anti-slip varnish may be applied between the A-shell inner surface and an inner surface of the cam sleeve, such as on the flexible tabs of the cam sleeve. This would further ensure that the A-shell and cam sleeve move as one.

Containers according to the present invention may be useful for all types of stick products that are applied to a surface by drawing the product across a surface. These include lipsticks, lip balms, deodorant sticks, anti-perspirant sticks, glue sticks, etc.

DETAILED DESCRIPTION

Throughout the specification, the term "comprises" means that a collection of objects is not necessarily limited to those explicitly recited, but may or may not include additional objects.

Herein, the term "glue" refers to any type of adhesive that bonds two surfaces together such that a significant non-zero tensile force is required to break the bond. Glues include solvent-based and polymer dispersion adhesives, pressure-sensitive adhesives and contact and hot melt adhesives that join two surfaces together.

For purposes of the present invention, a stick product is an elongated mass of solid or semi-solid product that is able to support its own weight when the elongated mass is suspended by one end.

Cam Sleeve

Figure 1:
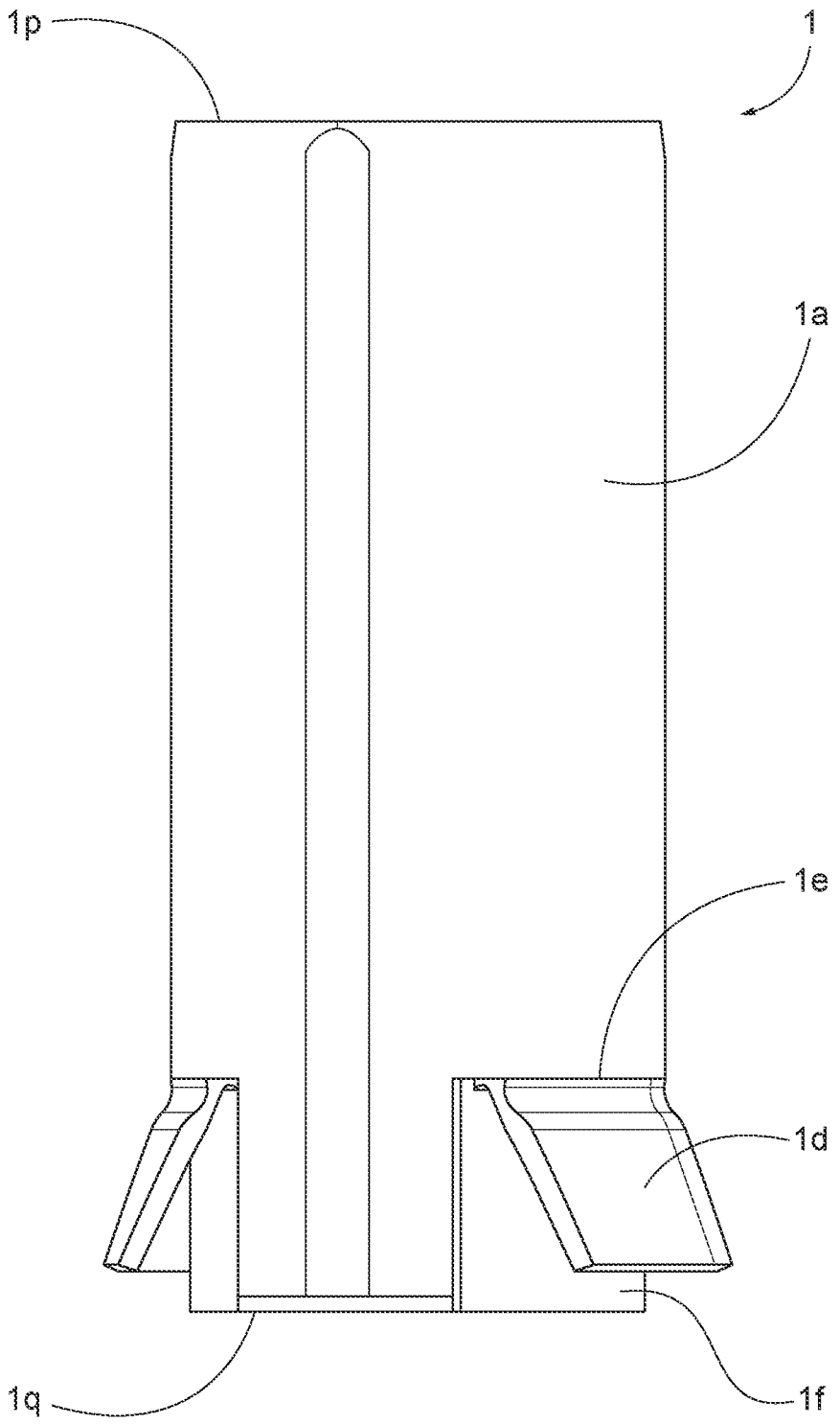
FIG. 1 is an elevation view of a cam sleeve with flexible tabs.
Figure 2:
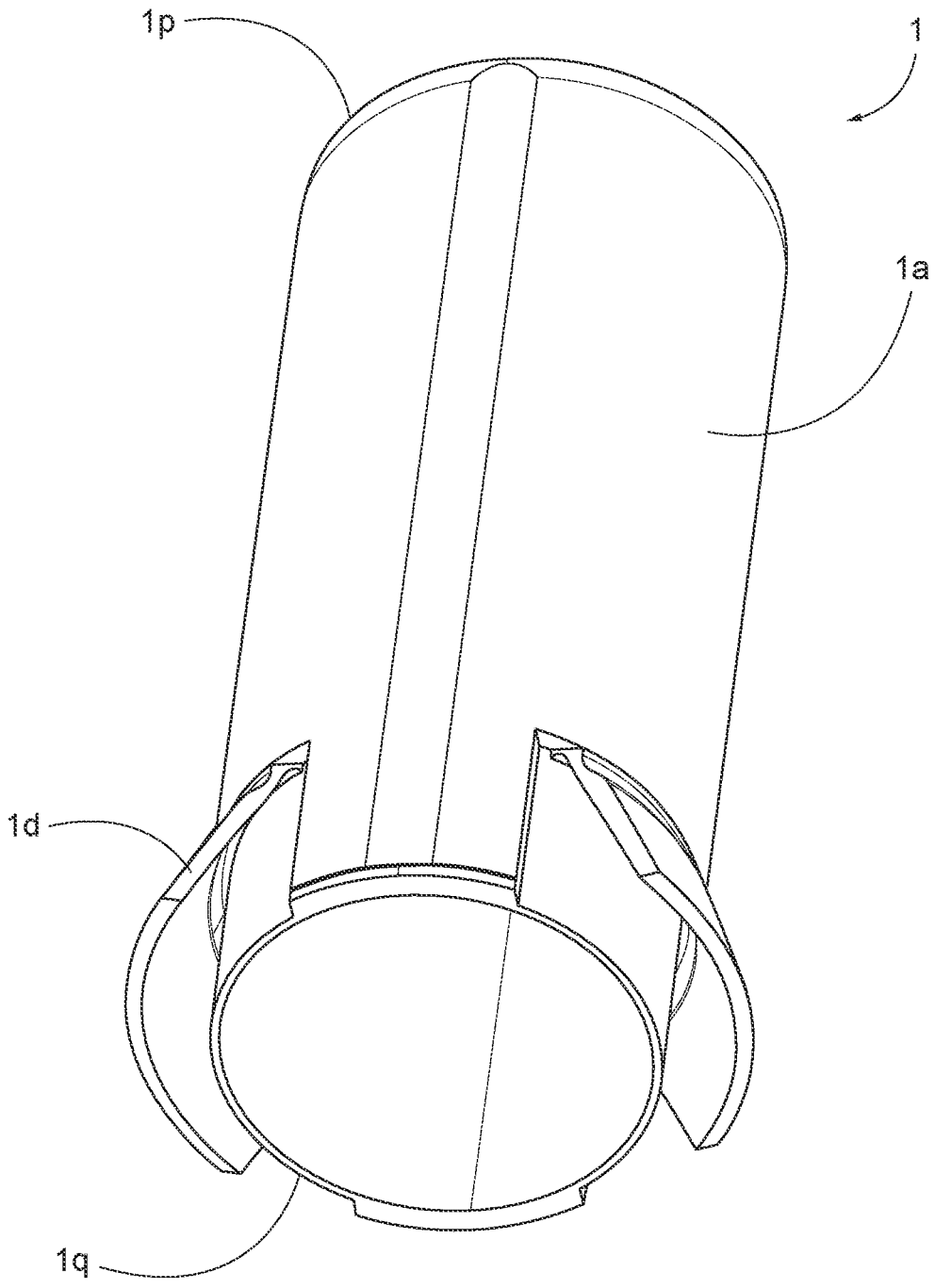
FIG. 2 is a perspective view of a cam sleeve with flexible tabs.

A cam sleeve (1) according to the present invention is shown in FIGS. 1 and 2. The cam sleeve comprises a generally cylindrical body that has a top (1*p*) and a bottom (1*q*) separated by a side wall. The top and bottom are opened to the inside of the cylindrical body. The top may be identified as that end of the cylindrical body from which the stick product will protrude during normal use of the container. The side wall is generally solid and has an outer surface (1*a*) and an inner surface (1*b*). The inner surface is provided with at least one helical groove (1*c*). The helical groove starts at the top of the cam sleeve and completes some number revolutions or fractions thereof, to end near the bottom of the cam sleeve. Also, the cam sleeve is able to mount to an inner body (4). For example, the cam sleeve may be mounted to the outside of the inner body by inserting the bottom of the inner body into the top of the cam sleeve. When fully seated on the inner body, the cam sleeve and inner body are concentric, and the cam sleeve and inner body can rotate with respect to one another.

Referring to FIG. 1, one or more recessed walls (1*f*) are located in the outer surface (la) of the cam sleeve (1), near the opened bottom (1*q*). Associated with each recessed wall is a flexible tab (1*d*). Each flexible tab arises from the recessed wall of the cam sleeve, connected to the cam sleeve by a living hinge (le). The living hinges bias the flexible tabs in an outward direction, so that the resting position of each tab is extended away from it associated recessed wall (1*f*). A force is required to cause the tabs to lie flat against the recessed walls. When the force is removed, the flexible tabs will return to their extended position as a result of the bias of the living hinges.

In general, all of the recessed tabs (1*d*) do not need to be located at the same height along the cam sleeve (1). However, it may be preferable to have all of the recessed tabs located at the same height along the cam sleeve. Preferably, there are at least two recessed tabs (1*d*) symmetrically located around the cam sleeve. Preferably, the total annular extent of the flexible tabs is at least 25% of the circumference of the cam sleeve, more preferably at least 50%, and even more preferably at least 75% of the circumference of the cam sleeve. Preferably, when the flexible tabs (1*d*) are resting against the recessed walls (lf), at least some portion of the flexible tabs will extend beyond the outer surface (la) of the cam sleeve. In other words, the diameter of the cam sleeve measured over the flexible tabs is greater than the diameter of the cam sleeve measured away from the flexible tabs.

A-Shell

Figure 3:
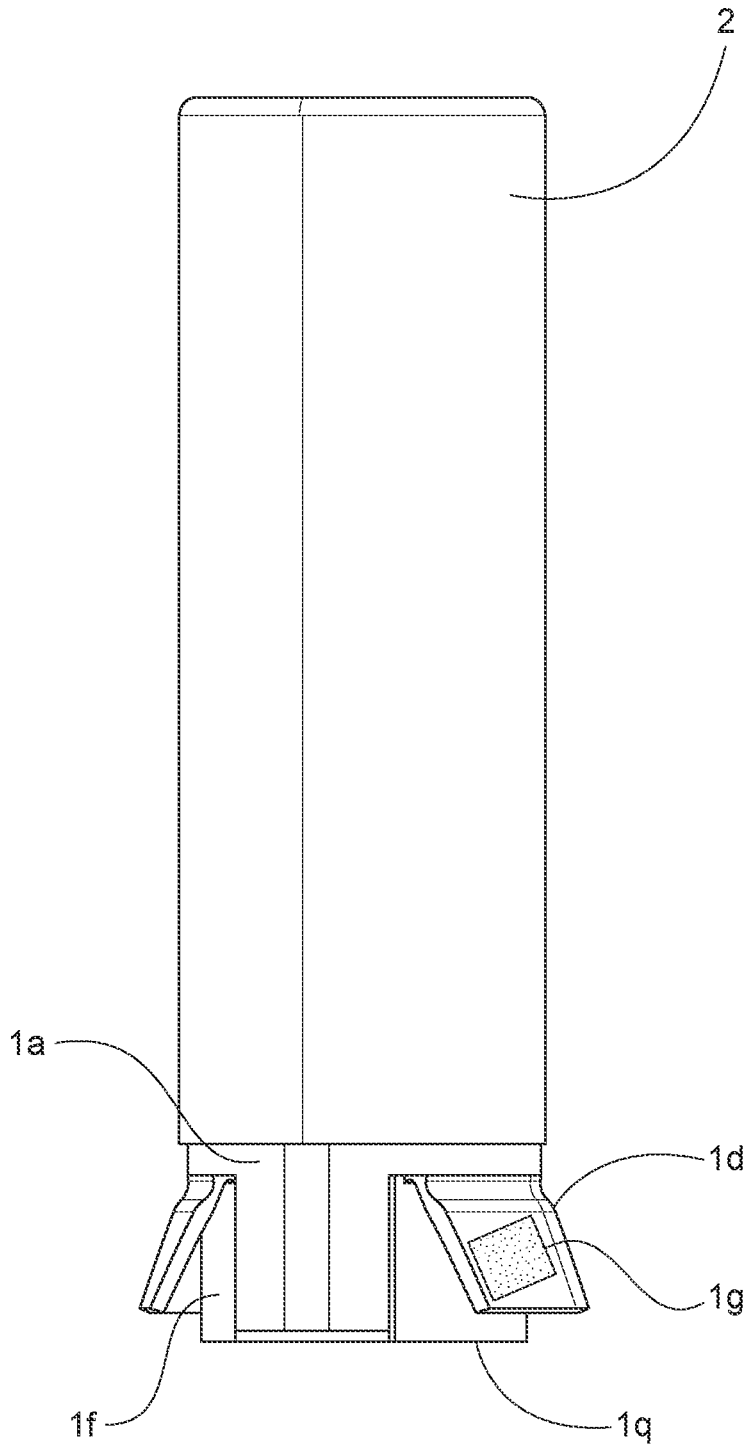
FIG. 3 depicts a cam sleeve with flexible tabs being inserted into an A-shell.
Figure 4:
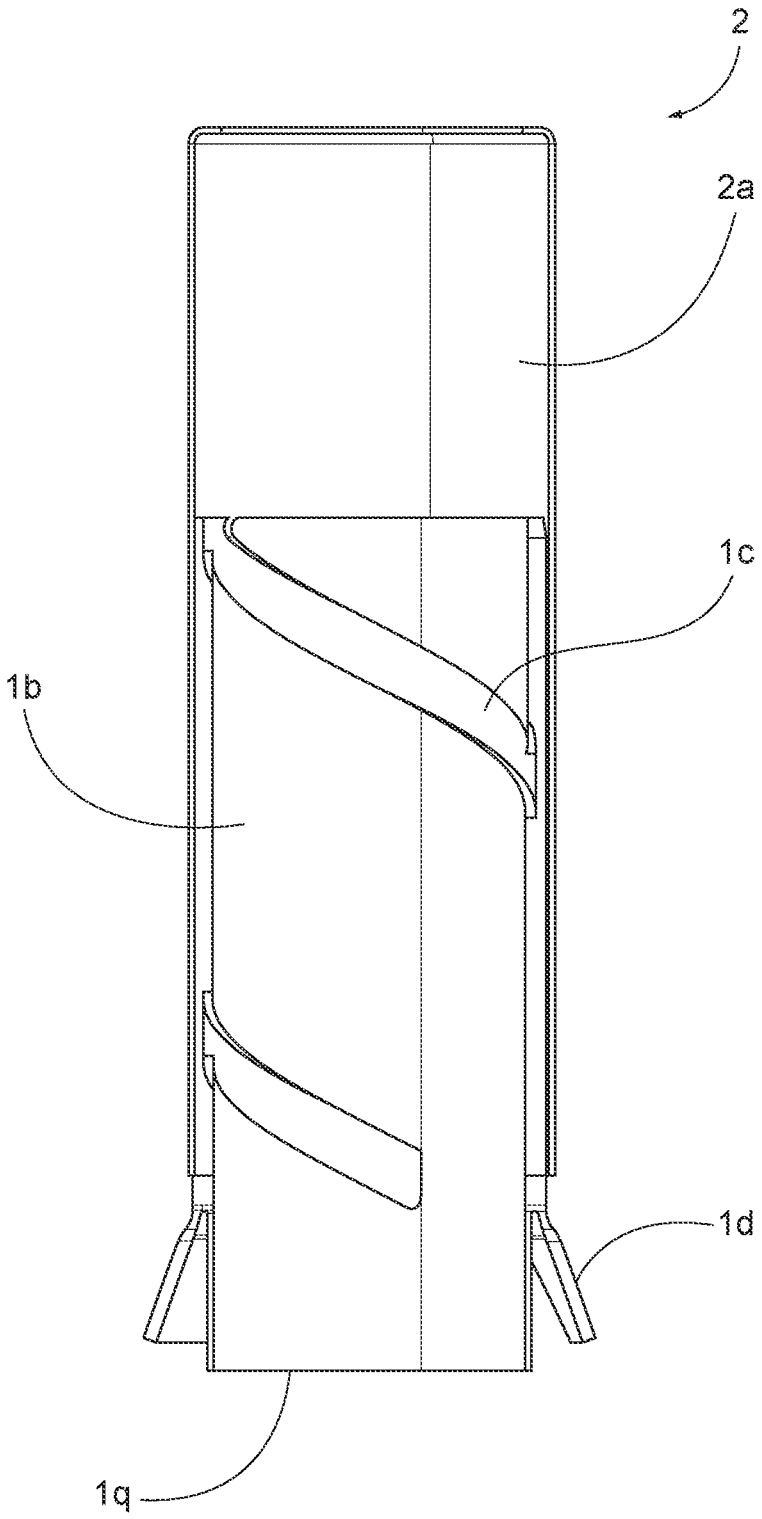
FIG. 4 is a cross sectional view of the depiction in FIG. 3.
Figure 5:
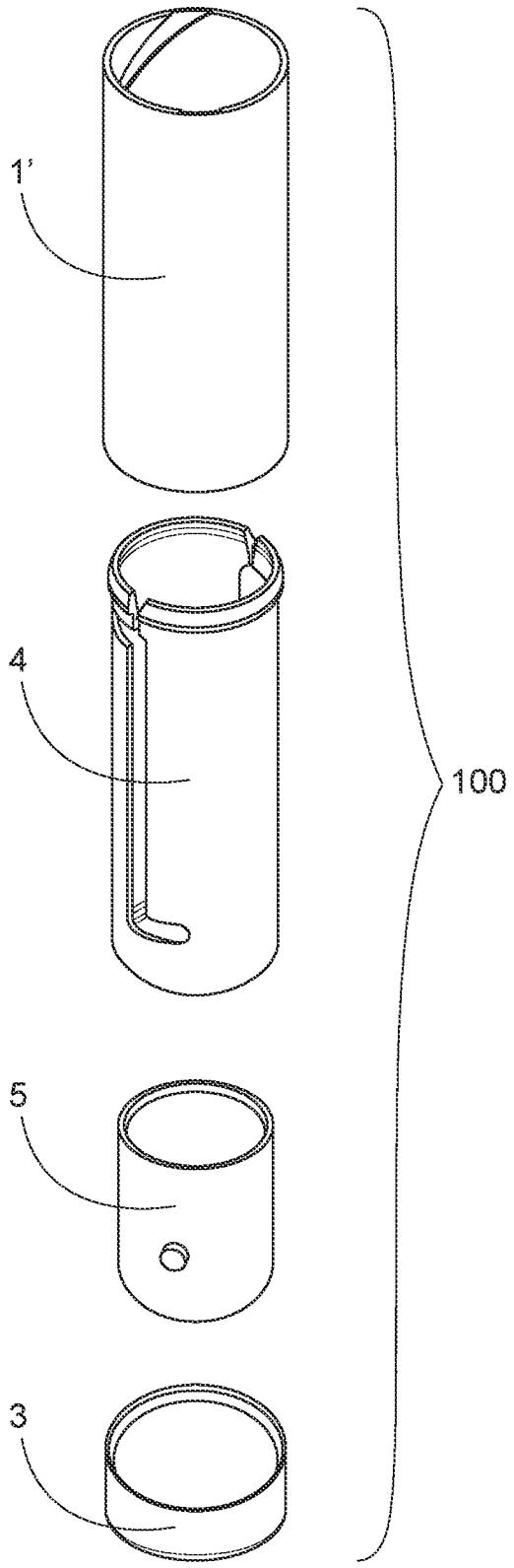
FIG. 5 is an exploded view that shows elements of a well known type of container for a stick product.

As shown in FIGS. 3 and 4, the A-shell (2) is a cylindrical tube that fits snugly over the cam sleeve (1) and flexible tabs (1*d*). The fit of the A-shell on the cam sleeve is sufficiently tight to cause the flexible tabs (1*d*) to lie flat against the recessed walls (1*f*) of the cam sleeve (1). The A-shell must be slid onto the cam sleeve in a direction that will cause the flexible tabs to lie flat against the recessed walls (1*f*). For the present discussion, and as shown in the drawings, the top (1*p*) of the cam sleeve is inserted into the A-shell first. Then, for ease of assembly, it is preferable if the flexible tabs are located near the opposite end, the bottom (1*q*) of the cam sleeve. For example, the recessed walls may open up onto the bottom of the cam sleeve, as shown in FIG. 1. Once assembled, the outward pressure exerted by the flexible tabs on the inner surface (2*a*) of the A-shell creates a substantial force of static friction; sufficient to ensure that the cam sleeve and A-shell will move as one.

To achieve a sufficient amount of static friction, the diameter of the cam sleeve (1) measured over the flexible tabs (1*d*) and the diameter of the inner surface of the A-shell (2) are sized for a minimum amount of interference. For example, the diameter of the cam sleeve (1) measured over the flexible tabs should be at least 0.02 mm greater than the diameter of the inner surface of the A-shell; preferably at least 0.05 mm greater, more preferably at least 0.08 mm greater than the diameter of the inner surface of the A-shell.

The frictional force between the A-shell and the flexible tabs acts in any direction, (i.e. axially or circumferentially), therefore, two separate mechanisms are not required (as in U.S. Pat. No. 9,603,434). Optionally, an anti-slip varnish (1*g*) may be applied between the A-shell inner surface and an outer surface of the cam sleeve. If an anti-slip varnish is used, then preferably the anti-slip varnish is applied to the flexible tabs of the cam sleeve. The anti-slip varnish would increase static friction between the A-shell and cam sleeve, without creating a permanent bond therebetween. Because the tabs are relatively small, and anti-slip varnish is relatively thin, and because the varnish is dried prior to the assembly of the A-shell and the cam sleeve, there is no concern that the varnish will smear in the way that glue does, as explained above.

What is claimed is:

1. A container for a stick product that comprises:
- a base;
- a cylindrical inner body connected to the base;
- a cam sleeve concentrically mounted around the inner body;
- a holder cup fitted into the cylindrical inner body;
- an A-shell that has an inner surface that fits snugly over the cam sleeve, such that raising and lowering of the holder cup is achieved by rotating the A-shell relative to the base; wherein:
- the cam sleeve comprises:
  - a generally cylindrical body that has an top and a bottom separated by a side wall, that has an outer surface;
  - one or more recessed walls located in the outer surface; and
  - a flexible tab associated with each recessed wall, connected to the cam sleeve by a living hinge that biases the flexible tabs in an outward direction; and
- the A-shell causes the flexible tabs to lie flat against the recessed walls of the cam sleeve, such that an outward pressure is exerted by the flexible tabs on the inner surface of the A-shell, and the outward pressure creates a force of static friction that is sufficient to ensure that the cam sleeve and A-shell will move as one when the A-shell is rotated relative to the base.

2. The container of claim 1 wherein the diameter of the cam sleeve measured over the flexible tabs is at least 0.02 mm greater than the diameter of the inner surface of the A-shell.

3. The container of claim 1 wherein the one or more recessed walls of the cam sleeve opens up onto the bottom of the cam sleeve.

4. A container for a stick product that comprises:
- a base;
- a hollow cylindrical inner body that is connected to the base, wherein the inner body comprises:
  - a wall with at least one longitudinal slot that extends through the wall;
- a cam sleeve concentrically mounted around the inner body, such that the cam sleeve and inner body can rotate with respect to each other, wherein the cam sleeve comprises:
  - a generally cylindrical body that has an top and a bottom separated by a side wall;
    - the side wall has an inner surface with at least one helical groove, and an outer surface with one or more recessed walls;

a flexible tab associated with each recessed wall, connected to the cam sleeve by a living hinge that biases the flexible tabs in an outward direction;

a holder cup for a stick product, the holder cup being fitted into the inner body, and comprising at least one cam follower that extends through the longitudinal slot of the inner body to engage the helical groove of the cam sleeve;

an A-shell that has an inner surface that fits snugly over the cam sleeve and flexible tabs, such that:

the flexible tabs to lie flat against the recessed walls of the cam sleeve;

an outward pressure is exerted by the flexible tabs on the inner surface of the A-shell; and the outward pressure creates a force of static friction that is sufficient to ensure that the cam sleeve and A-shell will move as one when the A-shell is rotated relative to the base.

5. The container of claim 4 wherein the diameter of the cam sleeve measured over the flexible tabs is at least 0.02 mm greater than the diameter of the inner surface of the A-shell.

6. The container of claim 4 wherein the one or more recessed walls of the cam sleeve opens up onto the bottom of the cam sleeve.

7. The container of claim 1 wherein an anti-slip varnish is applied between the A-shell inner surface and the cam sleeve outer surface.

* * * * *